US009601051B2

(12) United States Patent
Shin

(10) Patent No.: US 9,601,051 B2
(45) Date of Patent: Mar. 21, 2017

(54) ORGANIC LIGHT-EMITTING DISPLAY AND METHOD OF COMPENSATING FOR DEGRADATION OF THE SAME

(71) Applicant: SAMSUNG DISPLAY CO., LTD., Yongin, Gyeonggi-Do (KR)

(72) Inventor: Jeong Hwan Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 29 days.

(21) Appl. No.: 14/639,078

(22) Filed: Mar. 4, 2015

(65) Prior Publication Data

US 2016/0086537 A1 Mar. 24, 2016

(30) Foreign Application Priority Data

Sep. 19, 2014 (KR) ..... 10-2014-0125172

(51) Int. Cl.
*G09G 5/00* (2006.01)
*G09G 3/32* (2016.01)

(52) U.S. Cl.
CPC ... *G09G 3/3225* (2013.01); *G09G 2300/0819* (2013.01); *G09G 2300/0842* (2013.01); *G09G 2320/029* (2013.01); *G09G 2320/043* (2013.01); *G09G 2320/045* (2013.01); *G09G 2320/0686* (2013.01); *G09G 2360/16* (2013.01)

(58) Field of Classification Search
CPC ..... G09G 3/3233; G09G 2300/0819; G09G 2320/043; G09G 2320/029; G09G 2360/16
USPC .... 345/77, 102, 204–214, 589, 690; 349/33, 349/41; 358/3.26
See application file for complete search history.

(56) References Cited

U.S. PATENT DOCUMENTS

2001/0008418 A1* 7/2001 Yamanaka ..... H04N 5/3572 348/222.1
2002/0126209 A1* 9/2002 Yamada ..... H04N 3/1587 348/219.1
2004/0051684 A1 3/2004 Ishizuka
2008/0180385 A1* 7/2008 Yoshida ..... G09G 3/20 345/102
2008/0191976 A1 8/2008 Nathan et al.
2008/0252624 A1* 10/2008 Jang ..... G09G 3/3648 345/204
2009/0015741 A1* 1/2009 Kim ..... G02F 1/1343 349/33

(Continued)

FOREIGN PATENT DOCUMENTS

KR 10-2007-0118977 A 12/2007
KR 10-2008-0067888 A 7/2008
KR 10-2012-0087135 A 8/2012

*Primary Examiner* — Prabodh M Dharia
(74) *Attorney, Agent, or Firm* — Lewis Roca Rothgerber Christie LLP

(57) ABSTRACT

Provided are an organic light-emitting display comprising: a display panel which comprises a plurality of pixels, each of the pixels having an organic light-emitting diode (OLED); a sensor configured to detect degradation data indicating a degree of degradation of the OLED of each of the pixels and configured to calculate a degradation data difference between two or more adjacent pixels among the pixels; and a controller configured to set a compensation area utilizing the degradation data difference and configured to generate compensated image data by compensating in the compensation area in input image data.

19 Claims, 10 Drawing Sheets

(56) References Cited

U.S. PATENT DOCUMENTS

| | | | | |
|---|---|---|---|---|
| 2010/0007656 | A1* | 1/2010 | Okamoto | G09G 3/3233 345/214 |
| 2010/0149079 | A1* | 6/2010 | Yamashita | G09G 3/3233 345/87 |
| 2010/0201675 | A1* | 8/2010 | Kuranaga | G09G 3/325 345/211 |
| 2011/0037785 | A1* | 2/2011 | Shiomi | G09G 3/3426 345/690 |
| 2011/0037786 | A1* | 2/2011 | Hasegawa | G09G 5/10 345/690 |
| 2011/0249300 | A1* | 10/2011 | Nakagata | G06T 5/006 358/3.26 |
| 2011/0317935 | A1* | 12/2011 | Anan | G09C 5/00 382/274 |
| 2013/0070174 | A1* | 3/2013 | Yoshida | G09G 3/20 349/41 |
| 2014/0139568 | A1* | 5/2014 | Yoshida | G09G 3/20 345/691 |
| 2014/0160142 | A1* | 6/2014 | Lee | G09G 3/3208 345/589 |
| 2014/0168039 | A1* | 6/2014 | Kim | G09G 3/3208 345/82 |
| 2016/0012798 | A1* | 1/2016 | Oh | G09G 3/325 345/205 |
| 2016/0071445 | A1* | 3/2016 | Kim | G09G 3/006 345/212 |
| 2016/0098954 | A1* | 4/2016 | Bae | G09G 3/3208 345/77 |

* cited by examiner

Fig. 4

S

| | | | | |
|---|---|---|---|---|
| $S_{11}$ | $S_{12}$ | $S_{13}$ | ••••• | $S_{1m-1}$ |
| $S_{21}$ | $S_{22}$ | $S_{23}$ | ••••• | $S_{2m-1}$ |
| $S_{31}$ | $S_{32}$ | $S_{33}$ | ••••• | $S_{3m-1}$ |
| ⋮ | ⋮ | ⋮ | ⋱ | ⋮ |
| $S_{n-11}$ | $S_{n-12}$ | $S_{n-13}$ | ••••• | $S_{n-1m-1}$ |

ORGANIC LIGHT-EMITTING DISPLAY AND METHOD OF COMPENSATING FOR DEGRADATION OF THE SAME

CROSS-REFERENCE TO RELATED APPLICATION

This application claims priority to and the benefit of Korean Patent Application No. 10-2014-0125172 filed on Sep. 19, 2014 in the Korean Intellectual Property Office, the disclosure of which is incorporated herein by reference in its entirety.

BACKGROUND

1. Field

Embodiments of the present invention relate to an organic light-emitting display and a method of compensating for degradation of the same.

2. Description of the Related Art

An organic light-emitting display, which is drawing attention as a next-generation display, includes a self-luminous element that emits light by itself. Thus, the organic light-emitting display has advantages of fast response speed, high emission efficiency, high luminance, and wide viewing angle. The organic light-emitting display includes an organic light-emitting diode (OLED) as the self-luminous element. The OLED includes an anode, a cathode, and an organic compound layer formed between the anode and the cathode. The organic compound layer includes a hole injection layer (HIL), a hole transport layer (HTL), an emission layer (EML), an electron transport layer (ETL), and an electron injection layer (EIL). When a driving voltage is applied to the anode and the cathode, holes passing through the HTL and electrons passing through the ETL may move to the EML to form excitons. As a result, the EML may emit visible light.

OLEDs are degraded over time, resulting in a reduction in display luminance. The degree of degradation of an OLED is affected by the brightness of an input image. An OLED that has displayed a lot of bright images is more degraded than an OLED that has displayed a lot of dark images. That is, OLEDs of a display panel are degraded to different degrees. Therefore, a technology for ensuring uniform display luminance on one screen by compensating luminance according to the degree of degradation of each OLED has been suggested. However, the conventional technology compensates luminance by increasing a current applied to an OLED in proportion to the degree of degradation of the OLED. This can impose more loads on a degraded area, thereby accelerating degradation speed. That is, since more current is supplied to a more degraded OLED, the degradation speed of the OLED can be accelerated, and the life of a display can be reduced.

In addition, degradation information of an OLED may not be detected linearly with emission luminance of the OLED. That is, even if a degraded OLED is compensated based on detected degradation information, an increase in luminance resulting from the compensation of the OLED may not be linear. Therefore, even if the degraded OLED is directly compensated for, there may still be a luminance difference with another adjacent pixel.

SUMMARY

Aspects of the present invention provide an organic light-emitting display which makes a luminance difference substantially not visible (e.g., reduce visibility of the luminance difference) on a display panel by compensating a boundary area of a degraded pixel area.

Aspects of the present invention also provide a method of compensating for degradation of an organic light-emitting display, the method capable of making a luminance difference substantially not visible (e.g., reduce visibility of the luminance difference) on a display panel by compensating a boundary area of a degraded pixel area.

However, aspects of the present invention are not restricted to the one set forth herein. The above and other aspects of the present invention will become more apparent to one of ordinary skill in the art to which embodiments of the present invention pertain by referencing the detailed description of embodiments of the present invention given below.

According to an embodiment of the present invention, there is provided an organic light-emitting display including a display panel including a plurality of pixels, each of the pixels having an organic light-emitting diode (OLED), a sensor configured to detect degradation data indicating a degree of degradation of the OLED of each of the pixels and configured to calculate a degradation data difference between two or more adjacent pixels among the pixels and a controller configured to set a compensation area utilizing the degradation data difference and configured to generate compensated image data by compensating in the compensation area in input image data.

The compensation area includes a first area in which the degradation data difference is greater than reference data.

The controller is configured to set an area inside the first area as a degraded area and an area outside the first area as a normal area.

The controller is configured to set the compensation area such that a luminance level of the compensation area decreases from an area adjacent to the normal area toward an area adjacent to the degraded area, and the luminance level decreases according to a set slope from a luminance level of the normal area to a luminance of the degraded area.

The pixels may be arranged in a matrix pattern, and the adjacent pixels may not be arranged side by side along a row direction and a column direction.

The pixels may be arranged in a matrix pattern, and the adjacent pixels may be arranged side by side along a row direction or a column direction.

The compensation area includes pixels from among the plurality of pixels that are between a pixel having a degraded OLED and another one of the pixels having an un-degraded OLED.

The compensated image data is configured to compensate data voltages applied to the pixels in the compensation area.

The controller includes a compensation area setting unit configured to receive the degradation data difference and configured to set the compensation area utilizing the degradation data difference; and a compensated data generator configured to generate the compensated image data by processing the input image data according to the set compensation area.

Each of the pixels further includes a sensing transistor configured to apply a test current to the OLED in a state where a sensing mode has been activated, and the degradation data is a value of a driving voltage of the OLED generated by the test current.

The degradation data is detected through a data line coupled to each of the pixels.

According to another embodiment of the present invention, there is provided a method of compensating for degradation of an organic light-emitting display which includes a plurality of pixels, each of the pixels having an OLED, the method including: detecting degradation data indicating the degree of degradation of the OLED; calculating a degradation data difference between two or more adjacent pixels among the pixels; setting a compensation area utilizing the degradation data difference; and generating compensated image data by compensating in the compensation area.

The compensation area is set such that the compensation area includes a first area in which the degradation data difference is greater than a reference data.

When setting the compensation area, an area inside the first area is set as a degraded area, and an area outside the first area is set as a normal area.

A luminance level of the compensation area decreases from an area adjacent to the normal area toward an area adjacent to the degraded area, and the luminance level decreases according to a set slope from a luminance level of the normal area to a luminance of the degraded area.

The compensation area is defined as pixels between a pixel having a degraded OLED and a pixel having an un-degraded OLED.

The compensated image data compensates data voltages applied to the pixels in the compensation area.

Each of the pixels further includes a sensing transistor which applies a test current to the OLED in a state where a sensing mode has been activated, and the degradation data is a value of a driving voltage of the OLED generated by the test current.

The degradation data is detected through a data line coupled to each of the pixels.

BRIEF DESCRIPTION OF THE DRAWINGS

The above and other aspects and features of the present invention will become more apparent by describing in detail exemplary embodiments thereof with reference to the attached drawings, in which:

FIG. 4 is a schematic diagram illustrating mapped degradation data differences;

DETAILED DESCRIPTION

Figure 1:
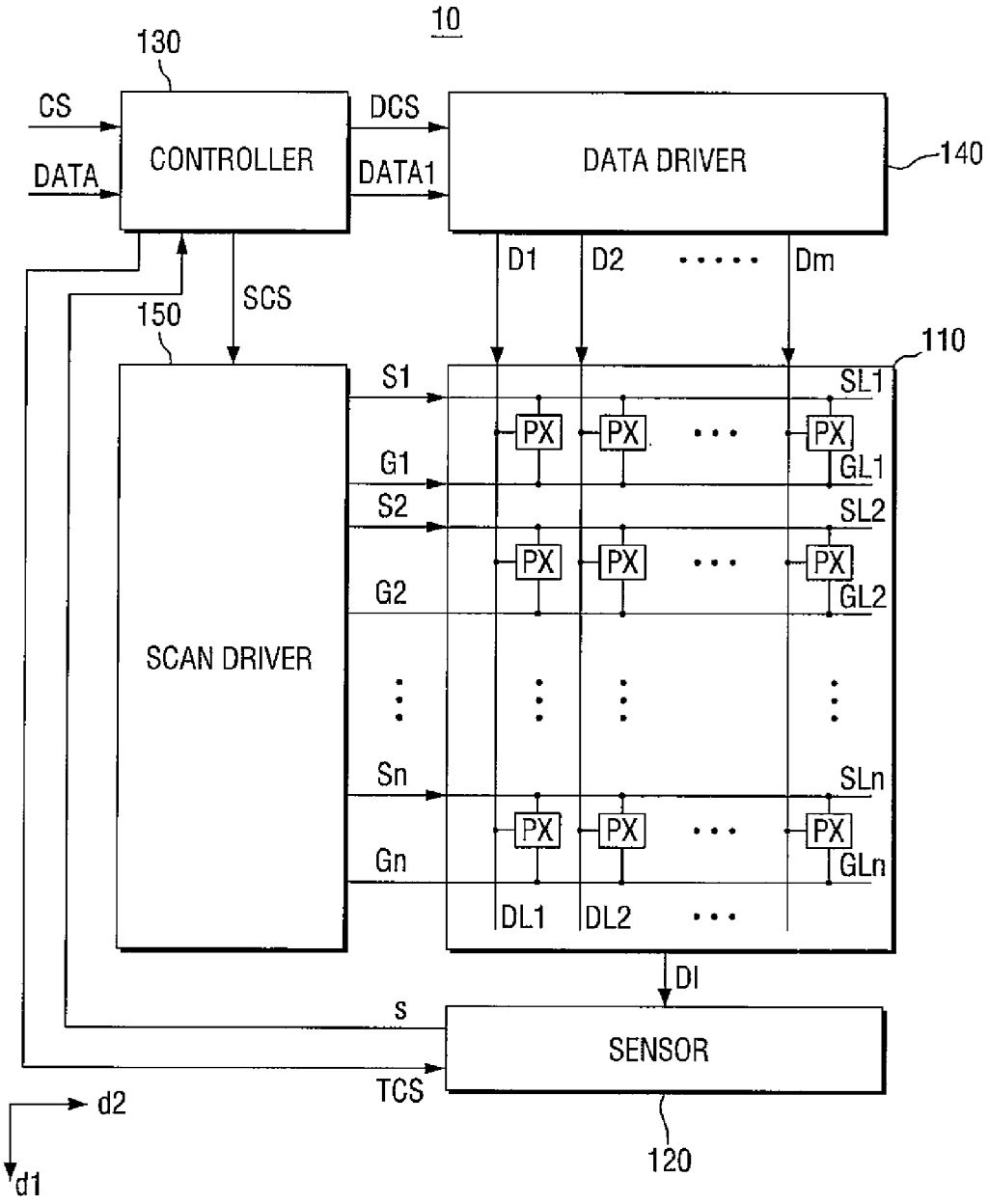
FIG. 1 is a block diagram of an organic light-emitting display according to an embodiment of the present invention.

Aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are provided to assist those of ordinary skill in the art in a comprehensive understanding of the invention, and the present invention is only defined within the scope of the appended claims and their equivalents.

The term "on" that is used to designate that an element is on another element or located on a different layer or a layer includes both a case where an element is located directly on another element or a layer and a case where an element is located on another element via another layer or still another element. In the entire description of embodiments of the present invention, the same drawing reference numerals are used for the same elements across various figures.

Although the terms "first, second, and so forth" are used to describe diverse constituent elements, such constituent elements are not limited by the terms. The terms are used only to differentiate a constituent element from other constituent elements. Accordingly, in the following description, a first constituent element may be a second constituent element.

It will be understood that when an element or layer is referred to as being "connected to" or "coupled to" another element or layer, it can be directly connected to or coupled to the other element or layer, or one or more intervening elements or layers may be present.

In addition, it will also be understood that when an element or layer is referred to as being "between" two element or layers, it can be the only element or layer between the two element or layers, or one or more intervening element or layers may also be present.

As used herein, the term "substantially," "about," and similar terms are used as terms of approximation and not as terms of degree, and are intended to account for the inherent deviations in measured or calculated values that would be recognized by those of ordinary skill in the art.

Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

Embodiments of the present invention will hereinafter be described with reference to the attached drawings.

Figure 2:
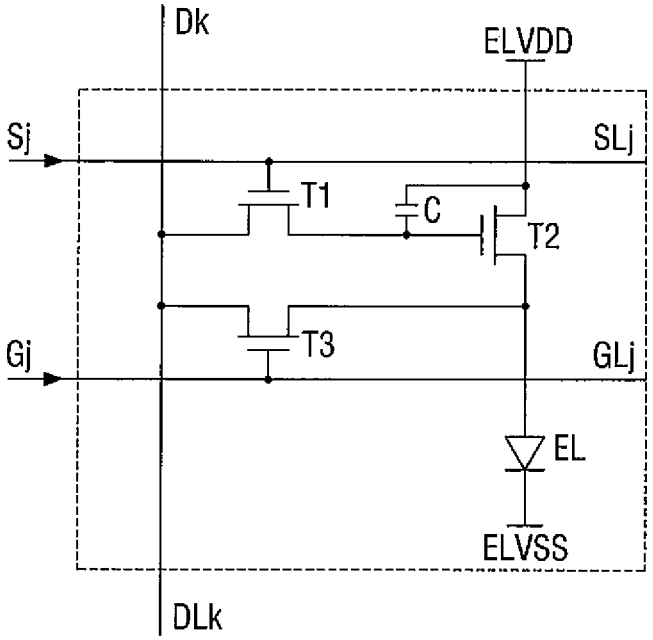
FIG. 2 is a circuit diagram of a pixel according to an embodiment of the present invention.

FIG. 1 is a block diagram of an organic light-emitting display 10 according to an embodiment of the present invention. FIG. 2 is a circuit diagram of a pixel according to an embodiment of the present invention.

Referring to FIGS. 1 and 2, the organic light-emitting display 10 includes a display panel 110, a sensor 120, a controller 130, a data driver 140, and a scan driver 150.

The display panel 110 may be an area where an image is displayed. The display panel 110 may include a plurality of scan lines SL1 through SLn, a plurality of data lines DL1 through DLm crossing the scan lines SL1 through SLn, and a plurality of pixels PX, each connected (e.g., coupled) to one of the scan lines SL1 through SLn and one of the data lines DL1 through DLm, where n and m are different natural numbers. Each of the data lines DL1 through DLm may cross the scan lines SL1 through SLn. That is, the data lines DL1 through DLm may extend in a first direction d1, and the scan lines SL1 through SLn may extend in a second direction d2 crossing the first direction d1. Here, the first direction d1 may be a column direction, and the second direction d2 may be a row direction. The scan lines SL1 through SLn may include first through $n^{th}$ scan lines SL1 through SLn arranged sequentially along the first direction d1. The data lines DL1 through DLm may include first through $m^{th}$ data lines DL1 through DLm arranged sequentially along the second direction d2.

The pixels PX may be arranged in a matrix pattern. Each of the pixels PX may be connected to one of the scan lines SL1 through SLn and one of the data lines DL1 through DLm. Each of the pixels PX may receive a data voltage applied to a connected data line in response to a scan signal provided from a connected scan line. That is, scan signals S1 through Sn to be transmitted to the pixels PX may be provided to the scan lines SL1 through SLn, and data voltages D1 through Dm may be provided to the data lines DL1 through DLm. Each of the pixels PX may receive a first power supply voltage ELVDD through a first power source line (not illustrated) and a second power supply voltage ELVSS through a second power source line (not illustrated).

The display panel 110 may include a plurality of gate lines GL1 through GLn extending in the same direction as the scan lines SL1 through SLn. The gate lines GL1 through GLn may include first through $n^{th}$ gate lines GL1 through GLn arranged sequentially along the first direction d1. The first scan line SL1 and the first gate line GL1 may be connected to the same pixel row group, and the other scan lines and the other gate lines may be connected to the same pixel row groups, respectively. Here, a scan line and a gate line may provide signals that turn on different transistors included in each pixel PX.

Each of the pixels PX may include a first transistor T1, a second transistor T2, a capacitor C, a third transistor T3, and an organic light-emitting diode (OLED) EL. The configuration of each pixel PX will hereinafter be described based on a pixel PX connected to a $j^{th}$ scan line SLj and a $k^{th}$ data line DLk, where j is a natural number of n or less, and k is a natural number of m or less. The configuration of the pixel PX may be any suitable structure that makes it possible to sense the degradation of the OLED EL.

The first transistor T1 of the pixel PX may have a gate terminal connected to the $j^{th}$ scan line SLj, a source terminal connected to the $k^{th}$ data line DLk, and a drain terminal connected to a gate terminal of the second transistor T2. The first transistor T1 may be a control transistor. That is, the first transistor T1 may be turned on by a scan signal Sk received through the $j^{th}$ scan line SLj and provide a data voltage Dk received through the data line DLk to the gate terminal of the second transistor T2.

The capacitor C may connect the gate terminal of the second transistor T2 and the first power supply voltage ELVDD. The data voltage Dk may be charged in the capacitor C, and the charged data voltage Dk may be provided to the gate terminal of the second transistor T2. The second transistor T2 may have the gate terminal connected to the drain terminal of the first transistor T1, a source terminal connected to the first power supply voltage ELVDD, and a drain terminal connected to the OLED EL. A current Ids corresponding to the relationship between a data voltage applied to the gate terminal of the second transistor T2 and a voltage of the source-drain terminals may be formed in a channel. The current Ids may be a driving current that causes the OLED EL to emit light, and the second transistor T2 may be a driving transistor.

The OLED EL may have an anode terminal connected to the drain terminal of the second transistor T2 and a cathode terminal connected to the second power supply voltage ELVSS. The OLED EL may emit light at a brightness level corresponding to the driving current.

The third transistor T3 may have a gate terminal connected to the $j^{th}$ gate line GLj, a source terminal connected to the $k^{th}$ data line DLk, and a drain terminal connected to the OLED EL. That is, the drain terminal of the third transistor T3 may be connected to the drain terminal of the second transistor T2. A gate signal G1 may be provided in a state where a sensing mode has been activated. That is, the third transistor T3 is a sensing transistor and may not operate in a state where the sensing mode has been deactivated.

In the activated sensing mode, a first current may be provided to the OLED EL. The first current may be provided through the $k^{th}$ data line DLk. However, the present invention is not limited thereto, and the first current may also be provided through a separate line (not illustrated). The first current is a test current used to sense the degree of degradation of the OLED EL and may have an arbitrarily set magnitude. A current driving voltage of the OLED EL generated by the first current may be applied to the $k^{th}$ data line DLk via the third transistor T3. The driving voltage may be a threshold voltage of the OLED EL, and the threshold voltage may increase as the degradation of the OLED EL progresses. That is, the current driving voltage may be a voltage that reflects the degree of degradation of the OLED EL.

In other words, in the sensing mode, a driving voltage formed in the $k^{th}$ data line DLk by the first current may be degradation data DI indicating the degree of degradation of the OLED EL. Here, a method of detecting the degradation data DI is not limited to the above example. That is, any other suitable technology that is known to one skilled in the art that is capable of sensing the degradation of the OLED EL can be applied. In some embodiments, a current flowing through the OLED EL may be measured. In this case, the degradation data DI may be detected as a current value.

The sensor 120 may be connected to the data lines DL1 through DLm of the display panel 110. In the sensing mode, the pixels PX may be defined as pixel row groups that are sequentially turned on by gate signals G1 through Gn provided sequentially. The sensor 120 may measure degradation data of pixels in each pixel row group through the data lines DL1 through DLm respectively connected to the pixels. Here, the sensor 120 may detect a difference between degradation data of adjacent pixels among the pixels PX.

The data driver 140 may provide the data voltages D1 through Dm to the data lines DL1 through DLm of the display panel 110. The data driver 140 may receive data control signals DCS and a compensated data signal DATA1 from the controller 130 and convert the compensation data signal DATA1 into the data voltages D1 through Dm by processing the compensated data signal DATA1 according to the data control signals DCS. If degradation data is detected through the data lines DL1 through DLm as in the current embodiment, lines to which the data voltages D1 through Dm are respectively output in the activated sensing mode may be blocked (e.g., electrically disconnected or electrically isolated) from the data lines DL1 through DLm.

The scan driver 150 may generate the scan signals S1 through Sn. The scan driver 120 may sequentially provide the scan signals S1 through Sn to the first through $n^{th}$ scan lines SL1 through SLn. In the activated sensing mode, the scan driver 150 may generate the gate signals G1 through Gn. The scan driver 150 may sequentially provide the first through $n^{th}$ gate signals G1 through Gn to the first through $n^{th}$ gate lines GL1 through GLn.

The controller 130 may receive control signals CS and an image signal R, G, B from an external system. Here, the control signals CS may be a vertical synchronization signal Vsync, a horizontal synchronization signal Hsync, a data enable signal DE, and a clock signal CLK. Based on the control signals CS, the controller 130 may generate scan control signals SCS for controlling the scan driver 140 and the data control signals DCS for controlling the data driver 130. The data control signals DCS may be, for example, a source start pulse (SSP), a source sampling clock (SSC), and a source output enable signal (SOE). The scan control signals SCS may be a gate start pulse (GSP) and a gate sampling clock (GSC).

The controller 130 may generate a sensing control signal TCS for controlling the sensor 120. The sensing control signal TCS may control activation and deactivation of the sensing mode. The sensing mode may be activated when the power of the organic light-emitting display 10 is turned on or off. That is, the sensing mode may be activated during a standby period in which the power of the organic light-emitting display 10 is turned on or off. However, the present invention is not limited thereto, and the sensing mode can also be activated periodically or by a user's setting during the operation of the organic light-emitting display 10.

In addition, the controller 130 may convert the input image data DATA into the compensated image data DATA1 by processing the input image data DATA by reflecting (e.g., by taking into account) sensing information received from the sensor 120. The compensated image data DATA1 may be image data compensated by reflecting (e.g., by taking into account) degradation information of the display panel 110. That is, since the organic light-emitting display 10 according to the current embodiment is driven by the compensated image data DATA1 generated by reflecting (e.g., by taking into account) the degradation information of the display panel 110, it can provide improved display quality.

The configurations and functions of the sensor 120 and the controller 130 will be described in greater detail with reference to FIGS. 3 through 9.

Figure 3:
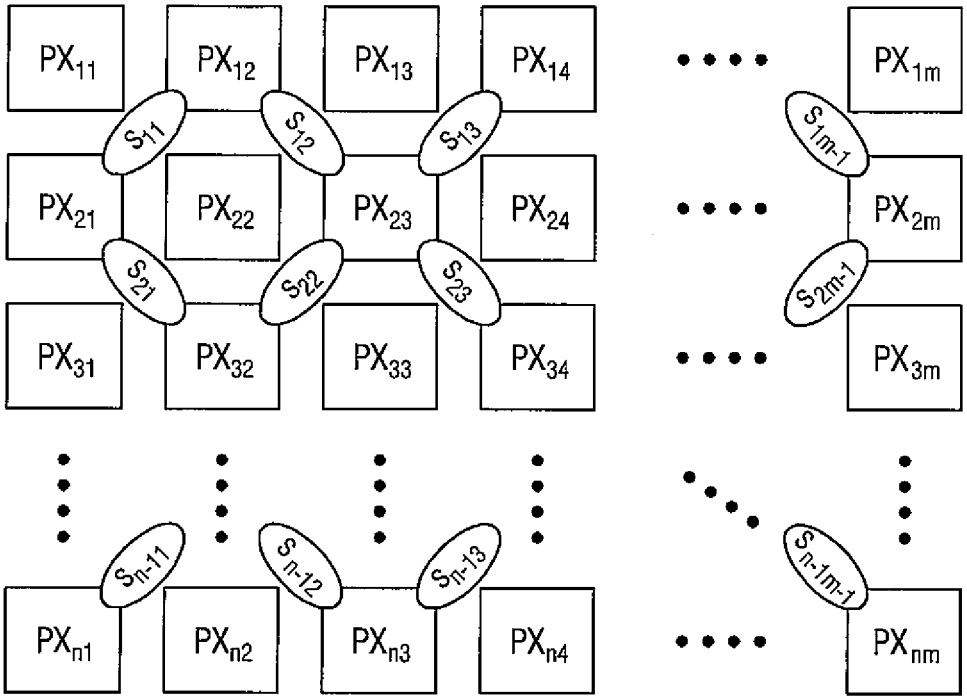
FIG. 3 is a schematic diagram illustrating degradation data mapped to each pixel.
Figure 5:
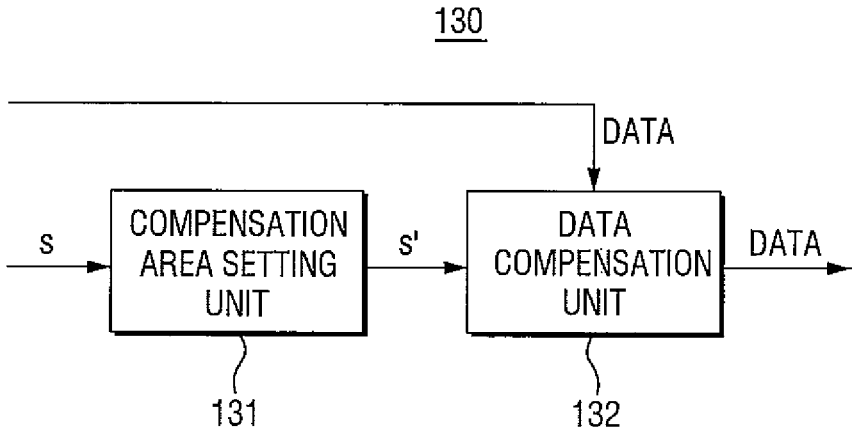
FIG. 5 is a block diagram of a controller according to an embodiment of the present invention.
Figure 6:
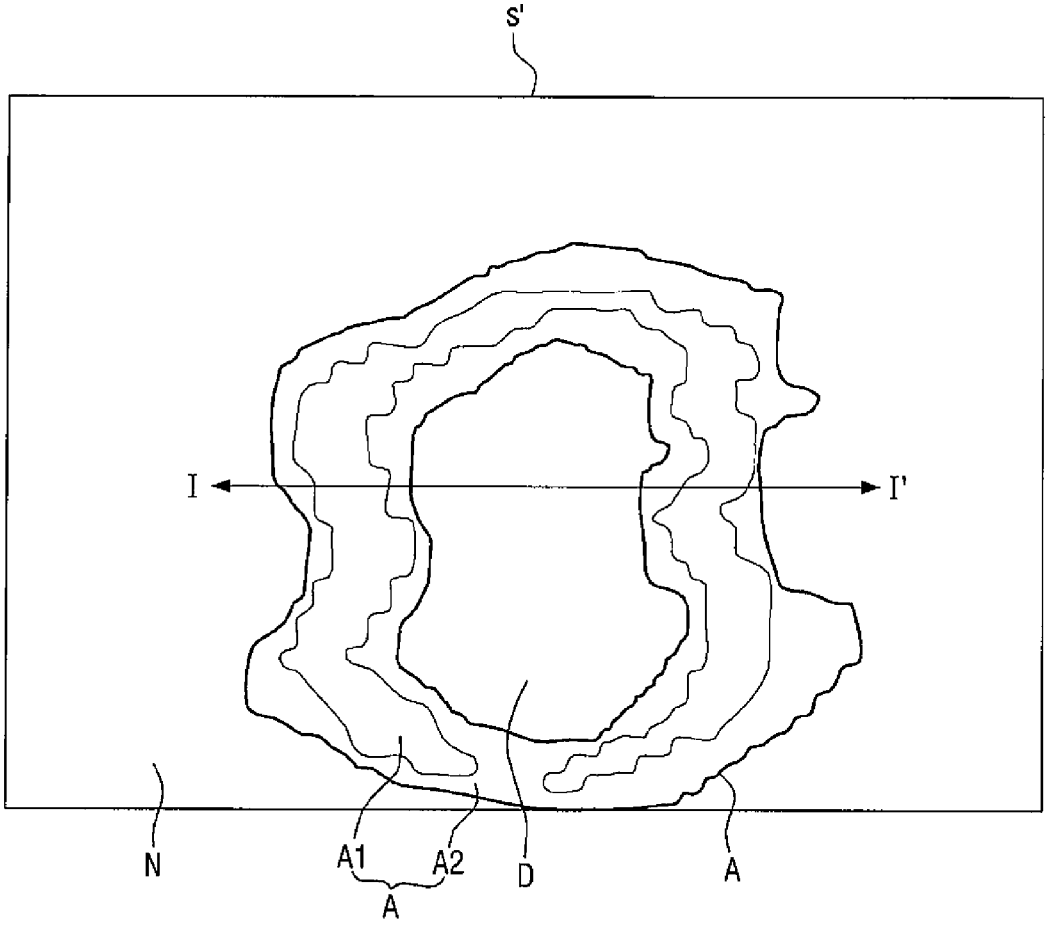
FIG. 6 is a schematic diagram illustrating a degradation data difference having a set compensation area.
Figure 7:
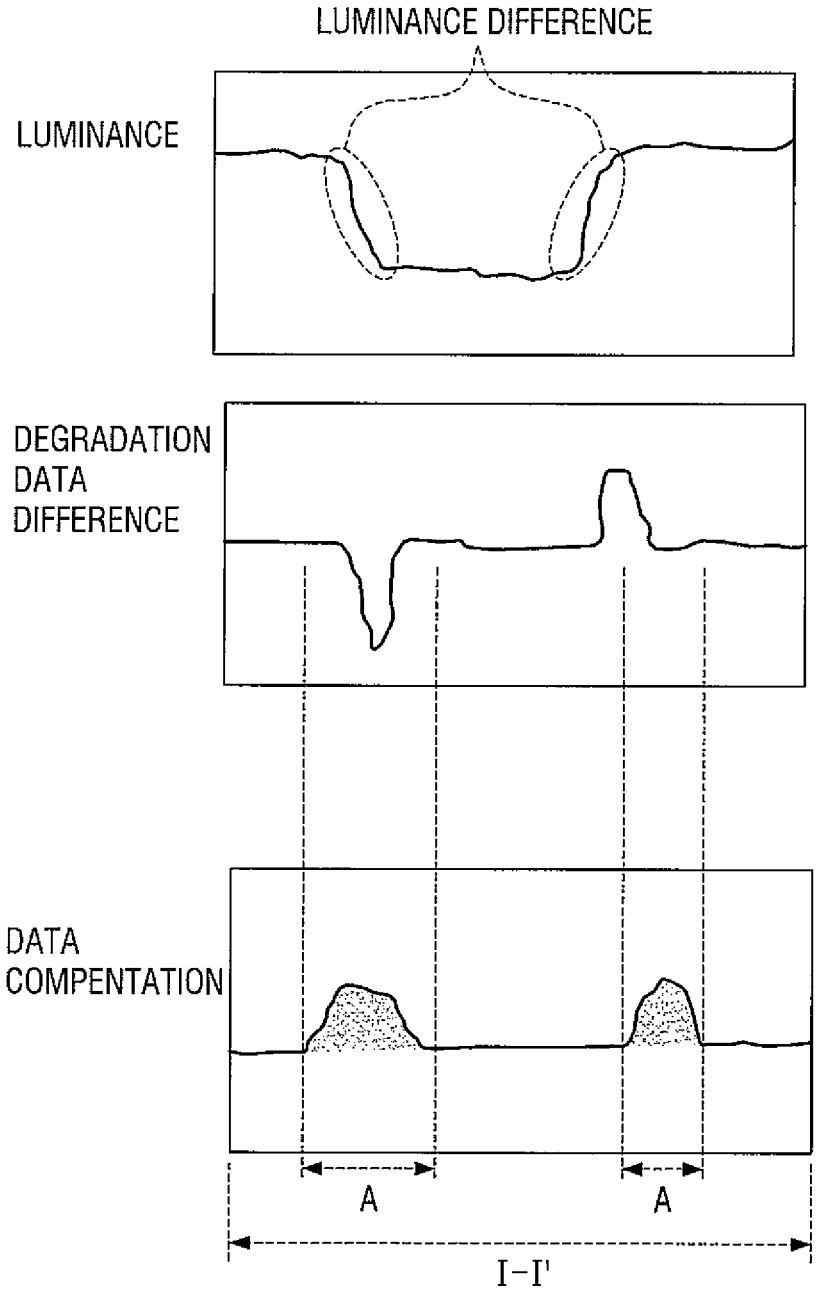
FIG. 7 is a graph illustrating the luminance, degradation data difference, and data compensation of an I-I' area of FIG. 6.
Figure 8:
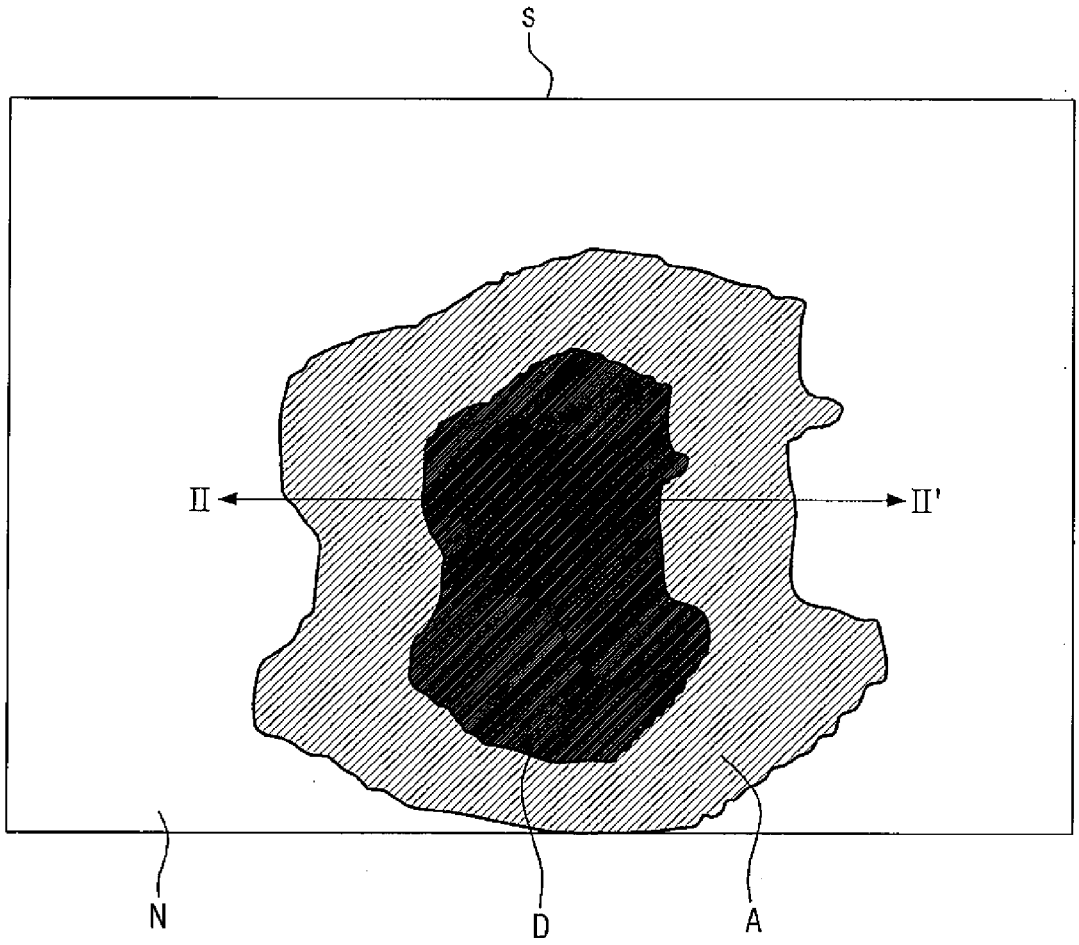
FIG. 8 is a diagram illustrating the luminance of each area to which compensated image data has been applied.
Figure 9:
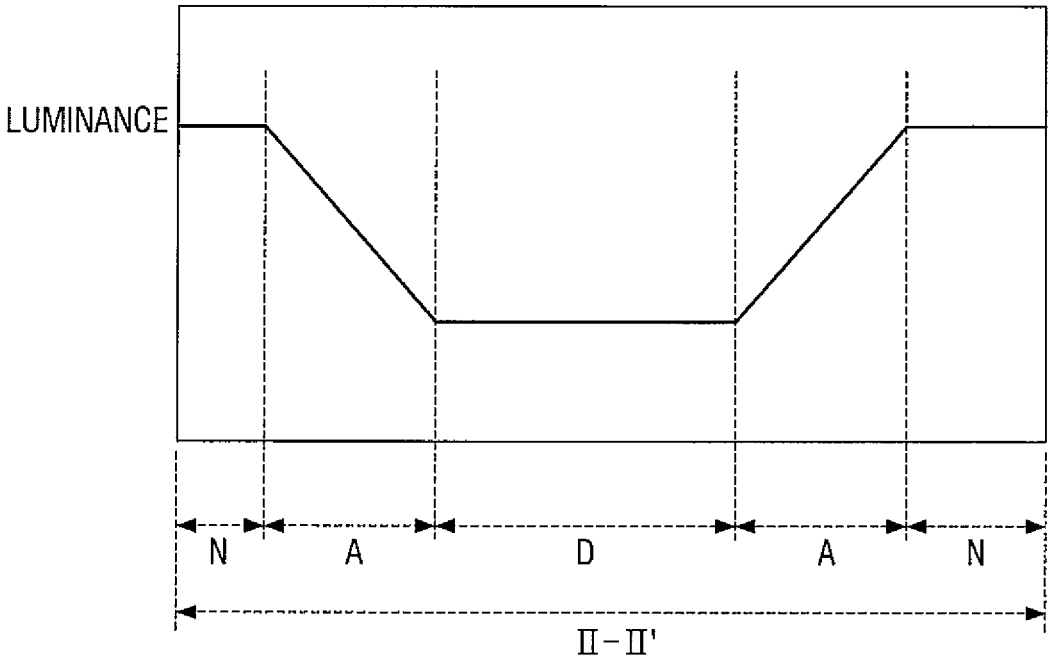
FIG. 9 is a graph illustrating the change in the luminance of an area II-II' of FIG. 8.

FIG. 3 is a schematic diagram illustrating degradation data mapped to each pixel. FIG. 4 is a schematic diagram illustrating mapped degradation data differences. FIG. 5 is a block diagram of the controller 130 according to an embodiment of the present invention. FIG. 6 is a schematic diagram illustrating a degradation data difference having a set compensation area. FIG. 7 is a graph illustrating the luminance, degradation data difference, and data compensation of an I-I' area of FIG. 6. FIG. 8 is a diagram illustrating the luminance of each area to which compensated image data has been applied. FIG. 9 is a graph illustrating the change in the luminance of an area II-II' of FIG. 8.

Referring to FIGS. 3 through 9, the sensor 120 may detect the degradation data DI indicating the degree of degradation of the OLED EL of each pixel PX. Here, the degradation data DI may be a voltage value, and the voltage value may be converted into a digital value by an analog-digital converter. The degradation data DI corresponding to each pixel PX may be mapped to a digital value and stored accordingly in a temporary memory.

The sensor 120 may calculate a difference between the degradation data DI of at least two adjacent pixels. Two adjacent pixels may not be arranged side by side along the row direction and the column direction. As illustrated in FIG. 3, the sensor 120 may calculate the difference between the degradation data DI of two pixels neighboring each other in a diagonal direction. The sensor 120 may read the degradation data DI of the pixels stored in the temporary memory and calculate the difference between the degradation data DI. Here, the positional relationship between the two adjacent pixels is not limited to the above example, and the two adjacent pixels may also be arranged side by side along the row direction or the column direction. That is, the difference between the degradation data DI of two pixels neighboring each other in the column direction or the difference between the degradation data DI of two pixels neighboring each other in the row direction can also be calculated. Here, the calculated degradation data difference s may be a numerical digital value, and the sensor 120 may map and store each calculated degradation data difference s as illustrated in FIG. 4.

If the degradation data DI of two neighboring pixels are not different, the stored value may be zero, and each degradation data difference s may have a value corresponding to the difference between the degradation data DI of two pixels. A method of calculating the degradation data difference s is not limited to the above example. In some embodiments, the degradation data DI of adjacent pixels may not be converted into digital values and may not be stored in a memory. That is, a detected analog voltage difference may be calculated by, for example, a differential amplifier, and the calculated difference may be directly converted into a digital value, i.e., the degradation data difference s. The calculated degradation data difference s may be provided to the controller 130.

The controller 130 may include a compensation area setting unit 131 and a data compensation unit 132. The compensation area setting unit 131 may receive the degradation data difference s and set a compensation area A utilizing the degradation data difference s. The compensation area setting unit 131 may provide compensated degradation data s' having the set compensation area A to the data compensation unit 132. The data compensation unit 132 may receive the input image data DATA and the compensated degradation data s' and generate the compensated image data DATA1 by processing the input image data DATA and the compensated degradation data s'. The compensated image data DATA1 may be generated by compensating the input image data DATA according to the compensated degradation data s'. The data compensation unit 132 may provide the generated compensated image data DATA1 to the data driver 140.

The compensation area setting unit 131 may set a first area A1 in which the degradation data difference s is greater than reference data as the compensation area A. Here, the reference data may be zero indicating no degradation data difference, but the present invention is not limited thereto. In some embodiments of the present invention, the reference data may be a degradation data difference such that a user can hardly recognize (or only recognize with difficulty) a luminance difference. The compensation area A may include the first area A1 and a second area A2 around the first area A1. This will be described in more detail later. The compensation area A may be a boundary area between a degraded area D and a normal area N. As illustrated in FIG. 6, an area inside the compensation area A may be defined as the degraded area D, and an area outside the compensation area A may be defined as the normal area N. More accurately, an area inside the first area A1 in which the luminance difference occurs may be the degraded area D, and an area outside the first area A1 may be the normal area N. The threshold voltage of the OLED EL of the degraded area D may increase as the degradation of the OLED EL progresses. In addition, the OLED EL of the degraded area D may show a lower luminance value than that of the normal area N for test currents of the same (or substantially the same) magnitude. Here, a portion recognized by a user as having degraded display quality may be an area in which the luminance difference occurs. That is, the user may recognize an area with a sharp luminance change (such as the boundary area between the normal area N and the degraded area D) as having degraded display quality. In the current embodiment, one pixel within an area defined as the degraded area D is not substantially different in luminance from other pixels within the degraded area D. Therefore, the user may not be able to recognize degradation of display quality in the degraded area D itself. For this reason, the controller 130 may set the boundary area between the degraded area D and the normal area N as the compensation area A and compensate for the compensation area A instead of directly compensating for the degraded area D, such that the user cannot substantially recognize the luminance difference. That is, the compensation area A may be defined as pixels disposed between pixels of the degraded area D and pixels of the normal area N. The controller 130 may generate the compensated image data DATA1 that compensates data voltages applied to the pixels of the compensation area A.

The controller 130 may compensate for the compensation area A such that the compensation area A has substantially no degradation data difference. That is, the controller 130 may compensate for the compensation area A such that a luminance change between the normal area N and the degraded area D does not occur sharply but forms a first slope. The first slope may be a slope that provides a luminance change with which a user cannot substantially recognize the luminance difference. The first slope may have a set value (e.g., a constant value or a predetermined value), and the luminance change between the normal area N and the degraded area D can be linearly compensated, but the present invention is not limited thereto.

To meet the first slope, the compensation area A may be set wider than the first area A1 in which the luminance difference occurs. That is, as illustrated in FIG. 6, the first area A1 where the luminance difference occurs and the second area A2 which is part of the normal area N and the degraded area D where the luminance difference does not occur may be set as the compensation area A so as to provide a luminance difference that meets the first slope. The compensation area setting unit 131 may set the compensation area A and provide the set compensation area A to the data compensation unit 132. The data compensation unit 132 may determine the amount of compensation that causes the normal area N and the degraded area D to have a luminance difference of the first slope. The data compensation unit 132 may generate the compensated image data DATA1 by compensating data voltages applied to pixels of the compensation area A according to the determined amount of compensation.

Luminance according to the compensated image data DATA1 may be as illustrated in FIGS. 8 and 9. That is, the normal area N, the compensation area A and the degraded area D may be compensated in a gradation pattern. Even when an image is displayed according to the compensated image data DATA1, a luminance level of the normal area N and a luminance level of the degraded area D may be different from each other. However, the luminance in the compensation area A may be reduced from an area adjacent to the normal area A toward an area adjacent to the degraded area D. Here, a luminance level of the compensation area A may decrease according to the first slope from the luminance level of the normal area N to the luminance level of the degraded area D. Therefore, the luminance difference between the degraded area D and the normal area N may be imperceptible to the eyes of a user. Consequently, a reduction in display quality due to the degradation of the OLED EL may be avoided.

Through the above-described compensation process, the organic light-emitting display 10 according to the current embodiment can provide improved display quality. In addition, since degraded pixels are not directly compensated, the problem of accelerating the degradation speed of the degraded pixels can be avoided.

Figure 10:
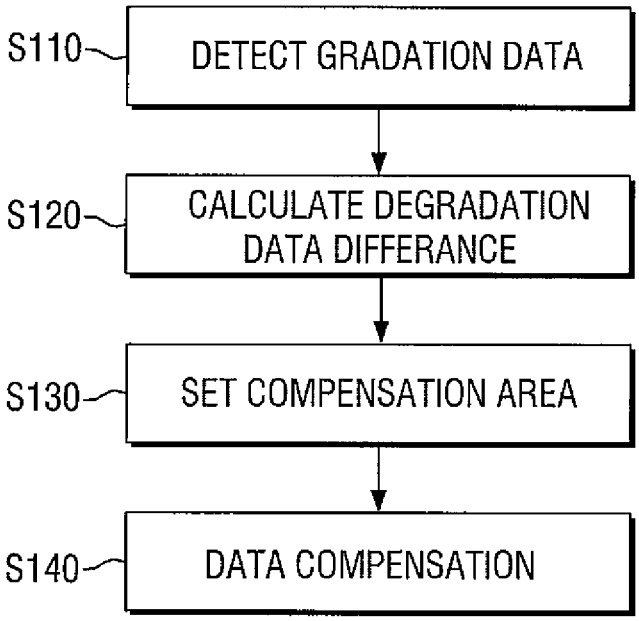
FIG. 10 is a flowchart illustrating a method of compensating for degradation of an organic light-emitting display according to an embodiment of the present invention.

A method of compensating for degradation of an organic light-emitting display according to an embodiment of the present invention will be described. FIG. 10 is a flowchart illustrating a method of compensating for degradation of an organic light-emitting display according to an embodiment of the present invention.

Referring to FIG. 10, the method of compensating for degradation of the organic light-emitting display according to the current embodiment includes detecting degradation data (operation S110), calculating a degradation data difference between two pixels (operation S120), setting a compensation area (operation S130), and generating compensated image data by compensating in the compensation area (operation S140).

First, degradation data is detected (operation S110).

Here, the organic light-emitting display according to the current embodiment may include a plurality of pixels, each having an OLED EL. The organic light-emitting display may be the organic light-emitting display 10 described above with reference to FIGS. 1 through 9, and thus a detailed description thereof will be omitted.

A controller 130 of the organic light-emitting display may activate a sensing mode. The sensing mode may be activated when the power of the organic light-emitting display is turned on or off. That is, the sensing mode may be activated during a standby period in which the power of the organic light-emitting display is turned on or off. However, the present invention is not limited thereto, and the sensing mode can also be activated periodically or by a user's setting during the operation of the organic light-emitting display. The controller 130 may control a scan driver 140 to output gate signals G1 through Gn for detecting the degradation data and block (e.g., electrically disconnect or electrically isolate) the connection between a data driver 150 and lines such that data voltages output from the data driver 150 cannot be applied to the lines. In addition, the controller 130 may apply a test current to each data line. The test current may flow to the OLED EL of each pixel via a sensing transistor that is turned on by a gate signal. A driving voltage of the OLED EL may be applied to each connected data line, and a sensor 120 may detect the degree of degradation of each OLED EL by measuring the driving voltage. Here, the driving voltage may be a threshold voltage of the OLED EL, and the threshold voltage may increase as the degradation of the OLED EL progresses. That is, the current driving voltage may be a voltage that reflects the degree of degradation of the OLED EL. Here, a method of detecting the degradation data is not limited to the above example. That is, any other suitable technology capable of sensing the degradation of the OLED EL can be applied. In some embodiments, a current flowing through the OLED EL may be measured. In this case, the degradation data may be detected as a current value.

A degradation data difference between two pixels is calculated (operation S120).

The sensor 120 may map the degradation data to each pixel and store the degradation data mapped to each pixel in a temporary memory. In addition, the sensor 120 may calculate a difference between the degradation data of at least two adjacent pixels. Two adjacent pixels may not be arranged side by side along a row direction and a column direction. That is, the two adjacent pixels may neighbor each other in a diagonal direction. The sensor 120 may read the degradation data of the pixels stored in the temporary memory and calculate the difference between the degradation data. Here, the calculated degradation data difference s may be a numerical digital value, and the sensor 120 may map and store each calculated degradation data difference s. The sensor 120 may provide the calculated degradation data difference s to the controller 130. Here, a method of calculating the degradation data difference s is not limited to the above example. In some embodiments, the degradation data of adjacent pixels may not be converted into digital values and may not be stored in a memory. That is, a detected analog voltage difference may be calculated by, for example, a differential amplifier, and the calculated difference may be directly converted into a digital value, i.e., the degradation data difference s.

A compensation area is set (operation S130).

The controller 130 may set a first area A1 in which the degradation data difference s is greater than reference data as a compensation area A. Here, the reference data may be zero indicating no degradation data difference, but the present invention is not limited thereto. In some embodiments of the present invention, the reference data may be set as a degradation data difference with which a user can hardly recognize (or only recognize with difficulty) a luminance difference. The compensation area A may be a boundary area between a degraded area D and a normal area N. More accurately, an area inside the first area A1 in which the luminance difference occurs may be defined as the degraded area D, and an area outside the first area A1 may be defined as the normal area N. Here, a portion recognized by a user as having degraded display quality may be an area in which the luminance difference occurs. That is, the user may recognize an area with a sharp luminance change (such as the boundary area between the normal area N and the degraded area D) as having degraded display quality. The controller 130 may set the boundary area between the degraded area D and the normal area N as the compensation area A and compensate for the compensation area A instead of directly compensating in degraded area D, such that the user cannot substantially recognize the luminance difference. The compensation area A may be compensated in a manner such that the luminance in the compensation area A decreases from an area adjacent to the normal area N toward an area adjacent to the degraded area D. The luminance of the compensation area A may decrease according to a first slope that provides a luminance change with which the user cannot substantially recognize the luminance difference. That is, the compensation area A may be set to as wide as an area corresponding to the first slope. To ensure the above area, a second area A2 around the first area A1 in which the luminance difference occurs may be included in the compensation area A. That is, the second area A2 may be part of the degraded area D and the normal area N and may be included in the compensation area A to ensure compensation according to the first slope.

Compensated image data is generated by compensating data corresponding to the compensation area (operation S140).

The controller 130 may generate compensated image data DATA1 by compensating an area corresponding to the compensation area A in input image data DATA. Here, the compensation area A may be defined as pixels disposed between pixels of the degraded area D and pixels of the normal area N. The controller 130 may generate the compensated image data DATA1 that compensates data voltages applied to the pixels of the compensation area A. That is, the normal area N, the compensation area A and the degraded area D may be compensated in a gradation pattern. Even when an image is displayed according to the compensated image data DATA1, a luminance level of the normal area N and a luminance level of the degraded area D may be different from each other. However, the luminance in the compensation area A may be reduced from an area adjacent to the normal area A toward an area adjacent to the degraded area D. Here, a luminance level of the compensation area A may decrease according to the first slope from the luminance level of the normal area N to the luminance level of the degraded area D. Therefore, the luminance difference between the degraded area D and the normal area N may be imperceptible to the eyes of a user. Consequently, a reduction in display quality due to the degradation of the OLED EL may be avoided.

Through the above-described compensation process, the method of compensating for degradation of the organic light-emitting display according to the current embodiment can provide improved display quality. In addition, since degraded pixels are not directly compensated, the problem of accelerating the degradation speed of the degraded pixels can be avoided.

Other elements used in the method of compensating for degradation of the organic light-emitting display are substantially identical to those of the organic light-emitting display 10 of FIGS. 1 through 9 identified by the same names, and thus a detailed description thereof is omitted.

Embodiments of the present invention may provide at least one of the following effects.

Because a luminance difference is not substantially visible on a display panel, a display quality can be improved.

In addition, since a degraded pixel is not directly compensated, the degradation speed of the pixel is not accelerated.

However, the effects of the present invention are not restricted to the one set forth herein. The above and other effects of embodiments of the present invention will become more apparent to one of daily skill in the art to which embodiments of the present invention pertains by referencing the claims.

While embodiments of the present invention has been particularly shown and described with reference to exemplary embodiments thereof, it will be understood by those of ordinary skill in the art that various changes in form and detail may be made therein without departing from the spirit and scope of the present invention as defined by the following claims and their equivalents. The exemplary embodiments should be considered in a descriptive sense only and not for purposes of limitation.

What is claimed is:

1. An organic light-emitting display comprising:

a display panel comprising a plurality of pixels, each of the pixels comprising an organic light-emitting diode (OLED);

a sensor configured to detect degradation data indicating a degree of degradation of the OLED of each of the pixels and configured to calculate a degradation data difference between two or more adjacent pixels among the pixels; and a controller configured to set a compensation area utilizing the degradation data difference and configured to generate compensated image data by compensating in the compensation area in input image data.

2. The organic light-emitting display of claim 1, wherein the compensation area comprises a first area in which the degradation data difference is greater than reference data.

3. The organic light-emitting display of claim 2, wherein the controller is configured to set an area inside the first area as a degraded area and an area outside the first area as a normal area.

4. The organic light-emitting display of claim 3, wherein the controller is configured to set the compensation area such that a luminance level of the compensation area decreases from an area adjacent to the normal area toward an area adjacent to the degraded area, and wherein the luminance level decreases according to a set slope from a luminance level of the normal area to a luminance of the degraded area.

5. The organic light-emitting display of claim 1, wherein the pixels are arranged in a matrix pattern, and wherein the adjacent pixels are not arranged side by side along a row direction and a column direction.

6. The organic light-emitting display of claim 1, wherein the pixels are arranged in a matrix pattern, and wherein the adjacent pixels are arranged side by side along a row direction or a column direction.

7. The organic light-emitting display of claim 1, wherein the compensation area comprises pixels from among the plurality of pixels that are between a pixel which comprises a degraded OLED and another one of the pixels which comprises an un-degraded OLED.

8. The organic light-emitting display of claim 7, wherein the compensated image data is configured to compensate data voltages applied to the pixels in the compensation area.

9. The organic light-emitting display of claim 1, wherein the controller comprises:

a compensation area setting unit configured to receive the degradation data difference and configured to set the compensation area utilizing the degradation data difference; and a compensated data generator configured to generate the compensated image data by processing the input image data according to the set compensation area.

10. The organic light-emitting display of claim 1, wherein each of the pixels further comprises a sensing transistor configured to apply a test current to the OLED in a state where a sensing mode has been activated, and wherein the degradation data is a value of a driving voltage of the OLED generated by the test current.

11. The organic light-emitting display of claim 10, wherein the degradation data is detected through a data line coupled to each of the pixels.

12. A method of compensating for degradation of an organic light-emitting display which comprises a plurality of pixels, each of the pixels comprising an OLED, the method comprising:

detecting degradation data indicating a degree of degradation of the OLED;

calculating a degradation data difference between two or more adjacent pixels among the pixels;

setting a compensation area utilizing the degradation data difference; and generating compensated image data by compensating in the compensation area.

13. The method of claim 12, wherein the compensation area is set such that the compensation area comprises a first area in which the degradation data difference is greater than a reference data.

14. The method of claim 13, wherein in the setting of the compensation area, an area inside the first area is set as a degraded area, and an area outside the first area is set as a normal area.

15. The method of claim 14, wherein a luminance level of the compensation area decreases from an area adjacent to the normal area toward an area adjacent to the degraded area, and wherein the luminance level decreases according to a set slope from a luminance level of the normal area to a luminance of the degraded area.

16. The method of claim 12, wherein the compensation area is defined as pixels between a pixel comprising a degraded OLED and a pixel comprising an un-degraded OLED.

17. The method of claim 16, wherein the compensated image data compensates data voltages applied to the pixels in the compensation area.

18. The method of claim 12, wherein each of the pixels further comprises a sensing transistor which applies a test current to the OLED in a state where a sensing mode has been activated, and wherein the degradation data is a value of a driving voltage of the OLED generated by the test current.

19. The method of claim 18, wherein the degradation data is detected through a data line coupled to each of the pixels.

* * * * *